US007108588B1

(12) United States Patent
Guthrie et al.

(10) Patent No.: US 7,108,588 B1
(45) Date of Patent: Sep. 19, 2006

(54) SYSTEM, METHOD, AND APPARATUS FOR WETTING SLURRY DELIVERY TUBES IN A CHEMICAL MECHANICAL POLISHING PROCESS TO PREVENT CLOGGING THEREOF

(75) Inventors: Hung-Chin Guthrie, Saratoga, CA (US); James Craig Nystrom, Sunnyvale, CA (US)

(73) Assignee: Hitachi Global Storage Technologies Netherlands B.V., Amsterdam (NL)

( * ) Notice: Subject to any disclaimer, the term of this patent is extended or adjusted under 35 U.S.C. 154(b) by 0 days.

(21) Appl. No.: 11/099,397

(22) Filed: Apr. 5, 2005

(51) Int. Cl.
*B24B 55/12* (2006.01)

(52) U.S. Cl. ..... 451/60; 451/446

(58) Field of Classification Search ..... 451/60, 451/443, 444, 56, 41, 288, 65
See application file for complete search history.

(56) References Cited

U.S. PATENT DOCUMENTS

| | | | | |
|---|---|---|---|---|
| 4,784,295 | A | | 11/1988 | Holmstrand |
| 5,578,529 | A | * | 11/1996 | Mullins ..... 438/692 |
| 5,679,063 | A | | 10/1997 | Kimura et al. |
| 5,716,264 | A | | 2/1998 | Kimura et al. |
| 5,837,610 | A | | 11/1998 | Lee et al. |
| 5,922,620 | A | | 7/1999 | Shimomura et al. |
| 5,957,759 | A | | 9/1999 | Cardenas et al. |
| 6,053,801 | A | * | 4/2000 | Pinson et al. ..... 451/56 |
| 6,059,920 | A | | 5/2000 | Nojo et al. |
| 6,102,782 | A | | 8/2000 | Custer |
| 6,139,406 | A | | 10/2000 | Kennedy et al. |
| 6,149,508 | A | | 11/2000 | Vanell et al. |
| 6,217,410 | B1 | | 4/2001 | Holzapfel et al. |
| 6,220,941 | B1 | | 4/2001 | Fishkin et al. |
| 6,280,299 | B1 | | 8/2001 | Kennedy et al. |
| 6,506,098 | B1 | | 1/2003 | Ho et al. |
| 2002/0065022 | A1 | | 5/2002 | Iwasaki et al. |
| 2003/0143933 | A1 | | 7/2003 | Baek et al. |

FOREIGN PATENT DOCUMENTS

| | | |
|---|---|---|
| JP | 61197162 | 9/1986 |
| JP | 200326225 | 11/2000 |

* cited by examiner

*Primary Examiner*—Robert A. Rose
(74) *Attorney, Agent, or Firm*—Bracewell & Giuliani LLP

(57) ABSTRACT

A moisturizing process for slurry delivery tubes in chemical mechanical polishing is disclosed. A mist of deionized water is dispensed directly into the tubes each time a high pressure spray bar automatically cycles. The tips of the tubes are kept wet enough to prevent the slurry from drying in and clogging the tubes. A fan-type spray nozzle is located in the bar and, when pressurized, dispenses a fine mist. A direction of the nozzle is modified to avoid overspraying the tool. Only the tips of the delivery tubes and part of the polishing pad receive the misted spray. The slurry is moisturized and never dries at the point of use as the mist is dispensed with each cycle of a pad rinse feature.

7 Claims, 3 Drawing Sheets

SYSTEM, METHOD, AND APPARATUS FOR WETTING SLURRY DELIVERY TUBES IN A CHEMICAL MECHANICAL POLISHING PROCESS TO PREVENT CLOGGING THEREOF

BACKGROUND OF THE INVENTION

1. Technical Field

The present invention relates in general to chemical mechanical polishing and, in particular, to an improved system, method, and apparatus for maintaining chemical mechanical polishing slurry delivery tubes in a wetted condition to prevent clogging therein.

2. Description of the Related Art

Magnetic recording is employed for large memory capacity requirements in high speed data processing systems. For example, in magnetic disc drive systems, data is read from and written to magnetic recording media utilizing magnetic transducers commonly referred to as magnetic heads. Typically, one or more magnetic recording discs are mounted on a spindle such that the disc can rotate to permit the magnetic head mounted on a moveable arm in position closely adjacent to the disc surface to read or write information thereon.

During operation of the disc drive system, an actuator mechanism moves the magnetic transducer to a desired radial position on the surface of the rotating disc where the head electromagnetically reads or writes data. Usually the head is integrally mounted in a carrier or support referred to as a "slider." A slider generally serves to mechanically support the head and any electrical connections between the head and the rest of the disc drive system. The slider is aerodynamically shaped to slide over moving air and therefore to maintain a uniform distance from the surface of the rotating disc thereby preventing the head from undesirably contacting the disc.

Typically, a slider is formed with essentially planar areas surrounded by recessed areas etched back from the original surface. The surface of the planar areas that glide over the disc surface during operation is known as the air bearing surface (ABS). Large numbers of sliders are fabricated from a single wafer having rows of the magnetic transducers deposited simultaneously on the wafer surface using semiconductor-type process methods. After deposition of the heads is complete, single-row bars are sliced from the wafer, each bar comprising a row of units which can be further processed into sliders having one or more magnetic transducers on their end faces. Each row bar is bonded to a fixture or tool where the bar is processed and then further diced, i.e., separated into sliders having one or more magnetic transducers on their end faces. Each row bar is bonded to a fixture or tool where the bar is processed and then further diced, i.e., separated into individual sliders each slider having at least one magnetic head terminating at the slider air bearing surface.

The slider head is typically an inductive electromagnetic device including magnetic pole pieces, which read the data from or write the data onto the recording media surface. In other applications the magnetic head may include a magneto resistive read element for separately reading the recorded data with the inductive heads serving only to write the data. In either application, the various elements terminate on the air bearing surface and function to electromagnetically interact with the data contained on the magnetic recording disc.

In order to achieve maximum efficiency from the magnetic heads, the sensing elements must have precision dimensional relationships to each other as well as the application of the slider air bearing surface to the magnetic recording disc. Each head has a polished ABS with flatness parameters, such as crown, camber, and twist. The ABS allows the head to "fly" above the surface of its respective spinning disk. In order to achieve the desired fly height, fly height variance, take-off speed, and other aerodynamic characteristics, the flatness parameters of the ABS need to be tightly controlled. During manufacturing, it is most critical to grind or lap these elements to very close tolerances of desired flatness in order to achieve the unimpaired functionality required of sliders.

Conventional lapping processes utilize either oscillatory or rotary motion of the workpiece across either a rotating or oscillating lapping plate to provide a random motion of the workpiece over the lapping plate and randomize plate imperfections across the head surface in the course of lapping. During the lapping process, the motion of abrasive particles carried on the surface of the lapping plate is typically along, parallel to, or across the magnetic head elements exposed at the slider ABS.

In magnetic head applications, the electrically active components exposed at the ABS are made of relatively softer, ductile materials. These electrically active components during lapping can scratch and smear into the other components causing electrical shorts and degraded head performance. The prior art lapping processes cause different materials exposed at the slider ABS to lap to different depths, resulting in recession or protrusion of the critical head elements relative to the air bearing surface. As a result, poor head performance because of increased space between the critical elements and the recording disc can occur.

Rotating lapping plates having horizontal lapping surfaces in which abrasive particles such as diamond fragments are embedded have been used for lapping and polishing purposes in the high precision lapping of magnetic transducer heads. Generally in these lapping processes, as abrasive slurry utilizing a liquid carrier containing diamond fragments or other abrasive particles is applied to the lapping surface as the lapping plate is rotated relative to the slider or sliders maintained against the lapping surface.

The slurries used in chemical mechanical polishing (CMP) processes solidify when allowed to dry. Under such conditions, the tubes used to dispense the slurry can become completely clogged with the dried slurry. Even if the dried slurry does not completely obstruct the delivery tubes, it can also act as a "filter" when in a semi-porous form that actually removes the required abrasive media entrained in the slurry. If the slurry is not properly dispensed, the wafers being processed may be over polished which results in scrapped wafers. Dry slurry can also form scratches on the wafers during the polishing process, resulting in either rework or additional scrap.

One prior art solution to the problem is to adjust a setting of the software used to control the process to initiate a "slurry flush" after a polish cycle has completed. However, typical slurry delivery systems are located about six feet away from the CMP tool. The cost to flush the slurry located in the tubing over this distance and then prime the system after each cycle is unacceptable. This same process may be repeated manually on a regular (e.g., daily) basis, but human operator errors introduce significant inconsistencies. Thus, although these prior art methods of addressing the problem are workable, an improved solution would be desirable.

SUMMARY OF THE INVENTION

One embodiment of a system, method, and apparatus for maintaining the slurry delivery tubes used in chemical mechanical polishing in a wetted condition to prevent clogging is disclosed. The present invention dispenses a mist of deionized (DI) water directly onto the slurry delivery tubes. In one embodiment, this process occurs each time the high pressure spray bar automatically cycles. This design keeps the tips of the delivery tubes wet enough to prevent the slurry from drying in and clogging the tubes. This process is fully automated to avoid errors associated with human interaction and results in reduced waste of the expensive slurry.

During formation of the high pressure spray bar, a hole is drilled through the length of the nozzle cavity in the high pressure spray bar. In the prior art, this hole was plugged with a solid cap. With the present invention, the plug is removed and a fan-type spray nozzle is inserted that dispenses a fine mist through an orifice when pressurized. The nozzle is modified to point down at a 15° angle to avoid overspraying the tool. This design allows only the tips of the delivery tubes and part of the polishing pad to receive the misted spray. As a result, the slurry is moisturized and never dries at the point of use as the mist is dispensed every time the automatic, software-controlled pad rinse feature is used by the tool.

The foregoing and other objects and advantages of the present invention will be apparent to those skilled in the art, in view of the following detailed description of the present invention, taken in conjunction with the appended claims and the accompanying drawings.

BRIEF DESCRIPTION OF THE DRAWINGS

So that the manner in which the features and advantages of the invention, as well as others which will become apparent are attained and can be understood in more detail, more particular description of the invention briefly summarized above may be had by reference to the embodiment thereof which is illustrated in the appended drawings, which drawings form a part of this specification. It is to be noted, however, that the drawings illustrate only an embodiment of the invention and therefore are not to be considered limiting of its scope as the invention may admit to other equally effective embodiments.

DETAILED DESCRIPTION OF THE INVENTION

Figure 1:
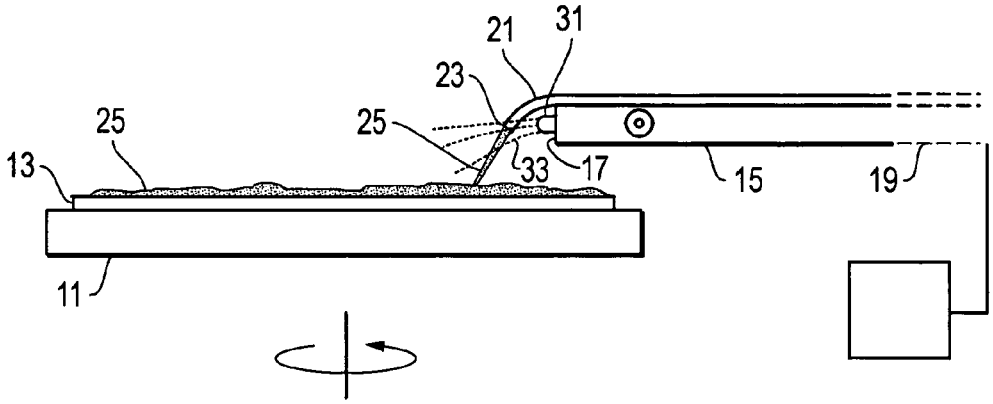
FIG. 1 is an isometric view of one embodiment of a spray bar constructed in accordance with the present invention.

Referring to FIGS. 1–4, the present invention is designed to maintain chemical mechanical polishing (CMP) slurry delivery tubes in a wetted condition to prevent them from clogging between slurry dispensing operations. As shown in FIG. 1, one embodiment of the system comprises a polishing pad 11 for polishing a workpiece 13, and a spray bar 15 (e.g., high pressure spray bar) located adjacent the polishing pad 11. The spray bar 15 includes a support arm having a distal end 17, and a mounting end 19 that is located opposite the distal end 17.

Figure 2:
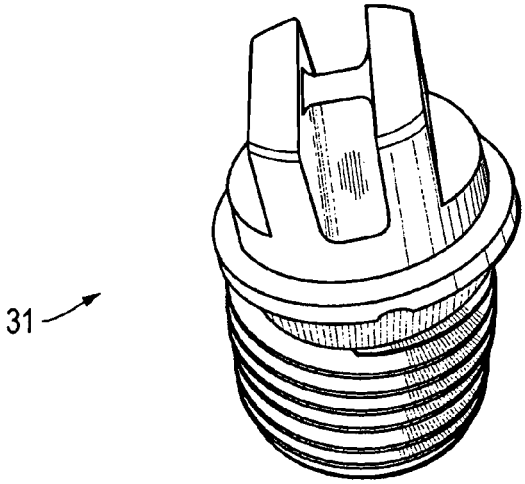
FIG. 2 is an enlarged isometric view of a nozzle utilized by the spray bar of FIG. 1 and is constructed in accordance with the present invention.
Figure 3:
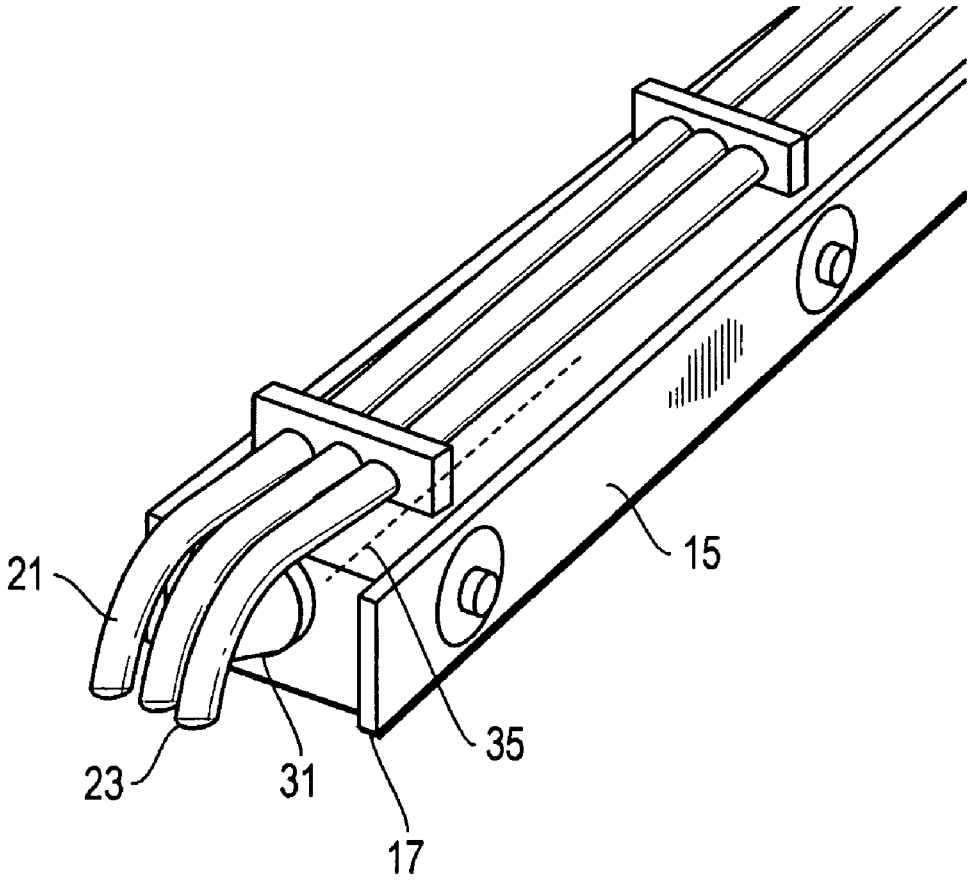
FIG. 3 is a schematic drawing of the spray bar of FIG. 1 during operation and is constructed in accordance with the present invention.
Figure 4:
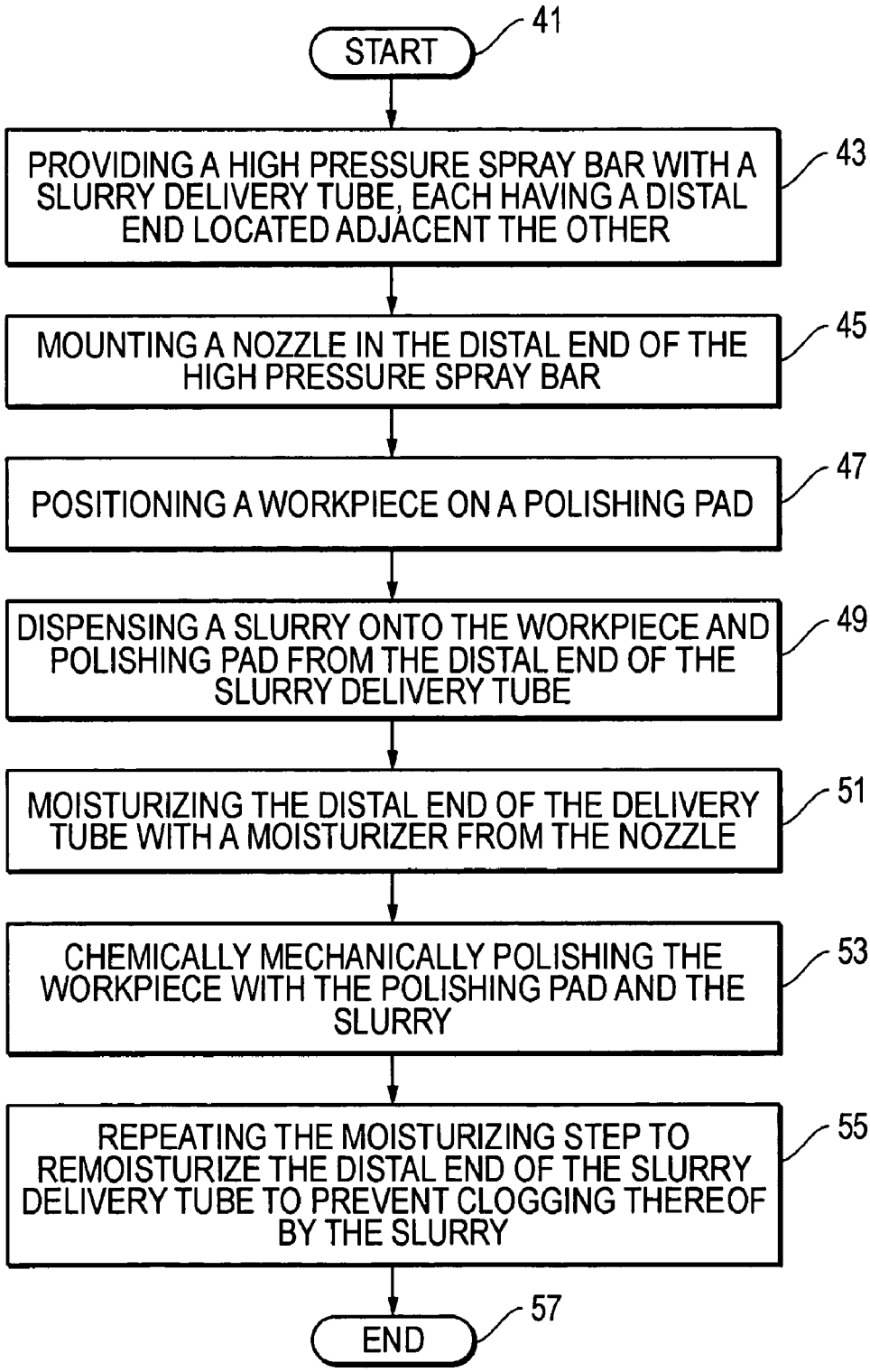
FIG. 4 is a high level flow diagram of one embodiment of a method constructed in accordance with the present invention.

In the embodiment illustrated in FIGS. 2 and 3, one or more slurry delivery tubes 21 (three shown) are mounted to an upper surface of the spray bar 15. Each of the slurry delivery tubes 21 has an opening on a distal end 23 thereof for dispensing slurry 25 to polish the workpiece 13 on the polishing pad 11. The distal ends 23 of the slurry delivery tubes 21 extend beyond the distal end 17 of the spray bar 15.

A nozzle 31 is mounted to the distal end 17 of the spray bar 15 adjacent the distal ends 23 of the slurry delivery tubes 21. The nozzle 31 is provided to dispense a moisturizer 33 onto the distal ends 23 of the slurry delivery tubes 21 for moisturizing the distal ends 23 of the slurry delivery tubes 21 to prevent clogging thereof by the slurry 25. In one version, the nozzle 31 dispenses a very fine mist of deionized water 33 directly onto the distal ends 23 of the slurry delivery tubes 21.

The nozzle 31 may be mounted in the end of a passage 35 (see dashed line) that is formed through the length of the spray bar 15. The nozzle 31 may comprise may different forms, but is illustrated as a fan-type spray nozzle having an offset angle of 15° to avoid overspraying the slurry delivery tubes 21 and limit the distribution of the moisturizer 33 to a tip 23 of the slurry delivery tube 21. In one embodiment, the nozzle 31 dispenses the moisturizer 33 each time the spray bar 15 automatically cycles to dispense slurry 25 to keep the distal ends 23 of the slurry delivery tubes 21 wet enough to prevent the slurry 25 from drying in and clogging the slurry delivery tubes 21. This process may be fully automated (e.g., via control 27) such that the distal ends 23 of the slurry delivery tubes 21 remain wetted between slurry dispensations without manual (e.g., human) intervention.

The present invention also comprises a method of chemical mechanical polishing. One embodiment of the method (FIG. 4) starts as indicated at step 41, and comprises providing a high pressure spray bar with a slurry delivery tube (step 43), each having a distal end located adjacent the other; mounting a nozzle in the distal end of the high pressure spray bar (step 45); positioning a workpiece on a polishing pad (step 47); dispensing a slurry onto the workpiece and polishing pad from the distal end of the slurry delivery tube (step 49); moisturizing the distal end of the slurry delivery tube with a moisturizer from the nozzle (step 51); chemically mechanically polishing the workpiece with the polishing pad and the slurry (step 53); and then repeating the moisturizing step to remoisturize the distal end of the slurry delivery tube to prevent clogging thereof by the slurry (step 55), before ending as indicated at step 57.

As suggested above, the method also may comprise dispensing a mist of deionized water directly onto the distal end of the slurry delivery tube; dispensing the moisturizer each time the spray bar automatically cycles to dispense slurry to keep the distal end of the slurry delivery tubes wet enough to prevent the slurry from drying in and clogging the slurry delivery tube; fully automating the process such that the distal end of the slurry delivery tube remains wetted between slurry dispensations without intervention; and/or providing the nozzle as a fan-type spray nozzle having an offset angle of 15° to avoid overspraying the slurry delivery tube and limit the distribution of the moisturizer to a tip of the slurry delivery tube and the polishing pad.

While the invention has been shown or described in only some of its forms, it should be apparent to those skilled in the art that it is not so limited, but is susceptible to various changes without departing from the scope of the invention.

What is claimed is:

1. A spray bar, comprising:

a support arm having a mounting portion and a distal end located opposite the mounting portion;

a delivery tube mounted to and extending along at least a portion of the support arm, a slurry delivery tube having an opening on a distal end of the slurry delivery tube for dispensing slurry, such that the distal end of the slurry delivery tube extends beyond the distal end of the support arm;

a nozzle mounted to the distal end of the support arm adjacent the distal end of the slurry delivery tube, the nozzle being adapted to dispense a moisturizer onto the distal end of the slurry delivery tube for moisturizing the distal end of the slurry delivery tube to prevent clogging thereof; and wherein the nozzle dispenses the moisturizer each time the spray bar automatically cycles to dispense slurry to keep a tip of the slurry delivery tube wet enough to prevent the slurry from drying in and clogging the slurry delivery tube.

2. The spray bar of claim 1, wherein the nozzle dispenses a mist of deionized water directly onto the slurry delivery tube.

3. The spray bar of claim 1, wherein a passage is formed through a length of the support arm.

4. The spray bar of claim 1, wherein the nozzle is a fan-type spray nozzle having an offset angle of 15° to avoid overspraying the slurry delivery tube and limit the distribution of the moisturizer to a tip of the slurry delivery tube.

5. A system for chemical mechanical polishing, the system comprising:

a polishing pad for polishing a workpiece;

a high pressure spray bar located adjacent the polishing pad and having a distal end and a passage formed through a length of the high pressure spray bar;

a plurality of slurry delivery tubes mounted to the high pressure spray bar, each of the slurry delivery tubes having an opening on a distal end thereof for dispensing slurry to polish the workpiece on the polishing pad, and the distal ends of the slurry delivery tubes extend beyond the distal end of the high pressure spray bar;

a nozzle mounted to the distal end of the high pressure spray bar adjacent the distal ends of the slurry delivery tubes, the nozzle being adapted to dispense a mist of deionized water directly onto the distal ends of the slurry delivery tubes for moisturizing the distal ends of the slurry delivery tubes to prevent clogging thereof by the slurry; wherein the nozzle comprises a fan-type spray nozzle having an offset angle of 15° to avoid overspraying the slurry delivery tube and limit the distribution of the mist to a tip of the slurry delivery tube; and wherein the nozzle dispenses the mist each time the spray bar automatically cycles to dispense slurry to keep the distal ends of the slurry delivery tubes wet enough to prevent the slurry from drying in and clogging the slurry delivery tubes, and the distal ends of the slurry delivery tubes are automatically wetted between slurry dispensations without intervention.

6. A method of chemical mechanical polishing, the method comprising:

(a) providing a high pressure spray bar with a slurry delivery tube, each having a distal end located adjacent the other;

(b) mounting a nozzle in the distal end of the high pressure spray bar;

(c) positioning a workpiece on a polishing pad;

(d) dispensing a slurry onto the workpiece and polishing pad from the distal end of the slurry delivery tube;

(e) moisturizing the distal end of the slurry delivery tube with a moisturizer from the nozzle by dispensing a mist of deionized water directly onto the distal end of the slurry delivery tube each time the high pressure spray bar automatically cycles to dispense slurry to keep the distal end of the slurry delivery tube wet enough to prevent the slurry from drying in and clogging the slurry delivery tube, such that the distal end of the slurry delivery tube remains wetted between slurry dispensations without intervention;

(f) chemically mechanically polishing the workpiece with the polishing pad and the slurry; and then (g) repeating step (e) to remoisturize the distal end of the slurry delivery tube to prevent clogging thereof by the slurry.

7. A method according to claim 6, wherein step (b) comprises providing the nozzle as a fan-type spray nozzle having an offset angle of 15° to avoid overspraying the slurry delivery tube and limit the distribution of the moisturizer to a tip of the slurry delivery tube and the polishing pad.

* * * * *